United States Patent [19]

Kuroki

[11] 3,976,518

[45] Aug. 24, 1976

[54] PROCESS FOR PRODUCING GRAIN-ORIENTED ELECTRIC STEEL SHEETS HAVING REMARKABLY IMPROVED MAGNETIC FLUX DENSITY

[75] Inventor: Katuro Kuroki, Kitakyushu, Japan

[73] Assignee: Nippon Steel Corporation, Tokyo, Japan

[22] Filed: Aug. 28, 1975

[21] Appl. No.: 608,686

Related U.S. Application Data

[63] Continuation-in-part of Ser. No. 529,515, Dec. 4, 1974, abandoned, which is a continuation of Ser. No. 377,122, July 6, 1973, abandoned.

[30] Foreign Application Priority Data

July 10, 1972 Japan ..... 47-68891

[52] U.S. Cl. ..... 148/113; 148/27; 148/31.5; 427/127

[51] Int. Cl.[2] ..... H01F 1/04

[58] Field of Search ..... 148/111, 112, 113, 31.55, 148/31.5, 27; 427/127

[56] References Cited

UNITED STATES PATENTS

| | | | |
|---|---|---|---|
| 3,671,337 | 6/1972 | Kumai et al. | 148/111 |
| 3,697,322 | 10/1972 | Lee et al. | 148/113 |
| 3,700,506 | 10/1972 | Tanaka et al. | 148/111 |

FOREIGN PATENTS OR APPLICATIONS

| | | | |
|---|---|---|---|
| 38-8214 | 6/1963 | Japan | 148/111 |

OTHER PUBLICATIONS

Saito, A; *Effect of Minor Elements . . . in Silicon Steel,* in *Nippon Kinzoku*, 27, 1963 pp. 191–195.

*Primary Examiner*—Walter R. Satterfield
*Attorney, Agent, or Firm*—Toren, McGeady and Stanger

[57] ABSTRACT

Process for producing grain-oriented electric steel sheets having a remarkably improved magnetic flux density, comprising hot rolling silicon steel material containing 0.025 to 0.085% C, 2.0 to 4.0% Si, 0.010 to 0.065% acid soluble Al, continuously annealing the steel at a high temperature between 950° and 1200°C before a final strong cold rolling, rapidly cooling the steel to precipitate AlN, cold rolling the steel by a one-step or two-step cold rolling including a final strong cold rolling with a reduction rate range of 81 to 95% into the final thickness, coating a separating agent on the sheet after a decarburization annealing, and subjecting the sheet to a final annealing to obtain a grain-oriented electric steel sheet having excellent excitation characteristics and $B_8$ characteristics of at least more than 1.90 Wb/m$^2$, said separating agent containing 0.1 to 15% of antimony or an antimony-containing compound.

2 Claims, 2 Drawing Figures

NOTE: THE STEEL SHEET WAS ANNEALED IN THE MIXED GAS OF 75% $H_2$ AND 25% $N_2$ UP TO A TEMPERATURE OF 1200 ℃ AND CHANGED TO 100% $H_2$ AT 1200 ℃.

PROCESS FOR PRODUCING GRAIN-ORIENTED ELECTRIC STEEL SHEETS HAVING REMARKABLY IMPROVED MAGNETIC FLUX DENSITY

CROSS REFERENCE TO RELATED APPLICATION

This application is a continuation-in-part of application Ser. No. 529,515, filed on Dec. 4, 1974, and now abandoned, which in turn was a continuation of Ser. No. 377,122, filed on July 6, 1973, and now abandoned.

The present invention relates to a process for producing a so-called grain-oriented electric steel sheet having a magnetizable axis <001> in the rolling direction.

BACKGROUND OF THE INVENTION

Grain-oriented electric steel sheets are used mainly as iron cores for transformers and other electrical appliances, and they must have good excitation and iron loss characteristics as the magnetic properties. In recent years, miniaturization of electrical appliances, such as, transformers has become a more and more important problem, and for this purpose, it is necessary to reduce the weight of the iron cores.

In general, in order to reduce the weight of iron cores used in various electrical appliances, a high degree of magnetic flux density must be utilized so that magnetic materials having good magnetization characteristics, namely $B_8$ characteristics are required. As compared with a magnetic material having low $B_8$ characteristics, a magnetic material having high $B_8$ characteristics shows a much better iron loss at a high magnetic field and shows a low increasing rate of iron loss accompanying an increase of the magnetic flux density.

In view of the above requirements, improvements of the magnetic density, which is naturally required with an increased size of electrical appliances, will be realized only by development of high magnetic flux density grain-oriented electric steel sheets.

SUMMARY OF THE INVENTION

One of the objects of the present invention is to provide products which satisfy the above requirements. The present invention makes it possible to produce grain-oriented electric steel sheets having a remarkably improved magnetic flux density, which show excellent excitation characteristics in the rolling direction, namely $B_8$ characteristics of at least more than 1.90 $Wb/m^2$.

The present inventors have already disclosed a process for producing grain-oriented electric steel sheets having such a high magnetic flux density by a one-step cold rolling of silicon steel containing a very small amount of Al with a reduction rate between 81 and 95% or by a two-step cold rolling including a final, strong cold rolling. Generally in the production of grain-oriented electric steel sheets, excellent magnetic characteristics in the rolling direction can be obtained due to the secondary recrystallization of the Goss structure showing an orientation of {110}<001> in the final annealing, and in this case, the precipitates, such as, nitrides, sulfides, and oxides formed by the addition elements play an important role. Conventionally, the contribution of these precipitates has been considered to restrict the grain growth of the matrix by their finely dispersed precipitation into the matrix and to promote the secondary recrystallization.

The present inventors have first discovered that some of the precipitates which precipitate in a specific orientation relative to the matrix have the ability to selectively grow grains of a specific orientation, and strictly control the orientation of the secondary recrystallization grains so that products having excellent $B_8$ characteristics can be obtained. AlN formed by the addition of Al in the present invention has the above selective ability.

It has been found that in the production of a high magnetic flux density grain-oriented electric steel sheet utilizing the effect of AlN, the dew point of the atmosphere used for the final annealing has a great influence on the properties of the final product. Thus, in order to consistently obtain a secondary recrystallization structure of excellent grain orientation, it is necessary to maintain the dew point of the atmosphere for the final annealing as low as possible.

The present inventors have succeeded in producing a very excellent grain-oriented electric steel sheet by adding antimony or an antimony-containing compound excluding alkali metal compound in the separating agent to be coated on the steel sheet and finally annealing the thus coated steel sheets at a high temperature. According to the present invention, the $B_8$ characteristics of the product are increased further by 0.2 $Wb/m^2$ to 0.5 $Wb/m^2$ and the effect of a glass-like film produced by reaction between the separating agent and the steel in the final annealing can be maximized and highly stabilized. Regarding the importance of the above glass-like film, it is widely used as an insulating film for grain-oriented electric steel sheets, but it has been recently discovered that the glass-like film also has a favourable influence on the iron loss characteristics and the magnetic strain characteristics. Thus, due to the difference in the thermal expansion between the glass-like film and the steel, the glass-like film gives tension to the steel sheet so that the iron loss and the magnetic strain are reduced.

It has been found that the influence by the glass-like film on the iron loss varies depending on the degree of the $B_8$ characteristics, and in the case of commercially available grain-oriented electric steel sheet having a $B_8$ level of 1.8 $Wb/m^2$, the iron loss is not effected, but in the case of a grain-oriented electric steel sheet having a magnetic flux density as high as $B_8$ of more than 1.9 $Wb/m^2$, a very large effect is produced on the iron loss value. The effect also varies depending on the thickness of the film, but it can reduce the total iron loss value by more than 30%.

The mechanism of increased control of the secondary recrystallization grains by antimony or an antimony-containing compound, and hence the mechanism of improving the $B_8$ characteristics have not been completely clarified from a theoretical viewpoint.

According to some literature, $Sb_2O_3$ is stable in air below 360°C, but absorbs oxygen rapidly at a temperature between 360° and 580°C and forms stable $Sb_2O_4$ at a temperature between 590° to 780°C. Near 900°C, it releases $O_2$ and again becomes $Sb_2O_3$.

It may be concluded that when the final annealing of the high magnetic flux density electric steel sheets is done by coating $Sb_2O_3$ on decarburized steel sheets, a part of the $Sb_2O_3$ absorbs $O_2$ brought in between the coil sheet together with the separating agent at a relatively low temperature to form $Sb_2O_4$ to lower the dew point and promotes a stable growth of the secondary recrystallization grains having excellent grain orientation, and releases $O_2$ during the glass-making period, namely about 900°C to provide favourable conditions for the glass formation. In the case of the addition of metallic Sb, it is assumed that it reacts with the oxygen present between the coil sheets to form $Sb_2O_3$ and gives a similar effects. Also, as a part of the Sb and $Sb_2O_3$ is gasified at a temperature above their melting points, it is dispersed onto the steel surface to give a shielding effect between the annealing atmosphere gas and the steel sheets and controls the absorption of N into the steel so that finely dispersed AlN in the steel can exhibit its maximum ability to closely control the Goss structure without causing changes in its size and distribution.

As the element to be added to a separating agent, boron, sulfur, selenium, etc. can be used in addition to antimony. in the case that one or more of these elements are added in a very small quantity into a molten steel, the secondary recrystallization grain of {110}<001> orientation is obtained. In this case, boron probably forms BN and Se, and S forms manganese compounds and such compounds act as inhibitors, and Sb segregates concentratedly along the grain boundaries, thus suppressing the growth of the primary recrystallization grains and accelerating the growth in the Goss orientation. These elements are not alike in the mechanism of suppression but offer equal effects as viewed from the result. This is because the addition agent is given to the molten steel at the beginning. However, in the case when these elements or compounds are used as the separating agent, their melting points or their states of diffusion into the steel are, of course, not alike. For instance, S and Se known by U.S. Pat. Nos. 3,333,991, 3,333,992 and 3,333,993 diffuse in the steel at the stage of the primary recrystallization; B in U.S Pat. Nos. 3,676,227 and 3,700,506 produces the effect at the time of the secondary recrystallization. Antimony of the present application diffuses in the steel after the secondary recrystallization starts, but does not directly affect the recrystallization phenomenon. In such a manner, the function of the addition agents is different between the case where they are added into the molten steel and the case where they are used as a separating agent. This will be further described hereinafter.

DESCRIPTION OF THE PREFERRED EMBODIMENTS

For illustrating one example of the improvement of $B_8$ characteristics of the product according to the present invention, silicon steel containing 0.045% C, 2.67% Si, 0.022% Al with the balance being Fe and unavoidable impurities was hot rolled into a 2.3 mm thickness. This hot rolled steel sheet was annealed for 5 minutes at 1100°C, quenched in water at 20°C, and subjected to one-step strong cold rolling with 88% reduction rate to a 0.275 mm thickness, and subjected to decarburization annealing. Then the sheets were coated with the separating agents prepared by adding antimony trioxide ($Sb_2O_3$) to magnesia in amounts of 0%, 0.5%, 1.0%, 2.0% and 3.0% (weight % MgO), and subjected to a final annealing at 1200°C for 20 hours. The results thus obtained are shown below.

| Addition of $Sb_2O_3$(%) | 0 | 0.5 | 1.0 | 2.0 | 3.0 |
|---|---|---|---|---|---|
| Product $B_8$ (Wb/m²) | 1.89 | 1.91 | 1.92 | 1.95 | 1.95 |

Various experiments regarding the addition of antimony and antimony compounds were made on various material compositions, with variations in sheet thicknesses, kinds of separating agents, and kinds and amounts of antimony. The results show that the optimum addition of antimony varies depending the combinations of the above factors, but in any case, the $B_8$ characteristics of the product is remarkably improved by the addition of antimony or an antimony compound.

U.S. Pat. No. 3,697,322, by adding a lithium compound to a separating agent, MgO or $Mg(OH)_2$, intends to improve the quality of the insulating coating of the grain-oriented silicon steel. One of such addition agents is lithium antimonide. It is supposed that lithium antimonide decomposes at a certain temperature during the final annealing into the oxide of antimony and the oxide or hydroxide of lithium. Generally in case when an alkali metal or a compound thereof is added as a separating agent, it destroys the oxide layer of a steel plate; this is not favorable for the formation of insulating coating. Particularly, the material of the present application contains a small quantity of aluminum, and the formation of insulating coating is thereby deteriorated and, as a result, the magnetic characteristic is hardly improved. This is caused presumably by the difference of composition from the material used by Lee et al.

Three kinds of silicon steel ingots different in aluminum content were broken down and hot-rolled into 2.8 m/m. The steels were annealed at 1100°C for 2 minutes, cooled with hot water at 100°C, and then pickled. After cold-rolled to the final sheet thickness of 0.30 m/m, the steel sheet was decarburized at 850°C for 3 minutes in a wet hydrogen atmosphere. To the thus treated steel sheets was applied MgO as a separating agent, with 4% $Sb_2O_3$ added as Sb, and 1% $LiOH.H_2O$ added, or with potassium antimonate ($K_2H_2.Sb_2O_7.4H_2O$) added in 4% as Sb. The steel sheets were subjected to a final annealing at 1200°C for 20 hours. The result is shown below.

| Samples | Separating Agents | | | |
|---|---|---|---|---|
| | MgO only | | MgO + $Sb_2O_3$ | |
| | $B_8$ | $W_{17/50}$ | $B_8$ | $W_{17/50}$ |
| 1 | 1.911 | 1.25 | 1.919 | 1.18 |
| 2 | 1.920 | 1.20 | 1.930 | 1.13 |
| 3 | 1.918 | 1.19 | 1.931 | 1.13 |

| Samples | Separating Agents | | | |
|---|---|---|---|---|
| | $MgO+Sb_2O_3+LiOH.H_2O$ | | $MgO+K_2H_2.Sb_2O_7.4H_2O$ | |
| | $B_8$ | $W_{17/50}$ | $B_8$ | $W_{17/50}$ |
| 1 | 1.906 | 1.28 | 1.910 | 1.25 |
| 2 | 1.919 | 1.19 | 1.921 | 1.18 |
| 3 | 1.920 | 1.22 | 1.920 | 1.20 |

As illustrated above, the effect of antimony is lost in the case when the alkali element is added. This may be explained from a fact that the oxide layer of $Al_2O_3$ is formed on the steel sheet because the material contains aluminum, and the formation of insulating coating is prevented by the addition of the alkali element. The atmosphere present between the sheets is likely to vary during the course of the final annealing.

The element added as the separating agent in the similar process is boron and its compounds as known by the aforesaid U.S. Pat. Nos. 3,676,227 and 3,700,506.

The function of these element and compounds is such that B or its compound diffuses from the surface of the steel sheet into the steel during the final annealing to form the boride in the steel and thereby suppresses the growth of the secondary recrystallization grains. As a result, the grain size of the product becomes smaller and, moreover, glass of good quality and low fusing point is formed and the iron loss is thereby improved. The role played by S and Se added together with B in the U.S. Pat. No. 3,700,506 is merely the facilitating of the diffusion of B in the steel sheet.

The present invention will be described in more detail referring to the attached drawings.

Antimony and its compounds in the present application neither act like boron which diffuses in the steel and affects the growth of the secondary recrystallization grains, nor act like S or Se. The function of antimony or its compound is to control the dew point of the atmosphere existing between the steel sheets by their absorption and release of $O_2$ as described before and to control the absorption of $N_2$ into the steel sheet the during the final annealing.

The difference of $N_2$ content in the steel sheet caused by different separating agents during the finishing annealing process.

Figure 1:
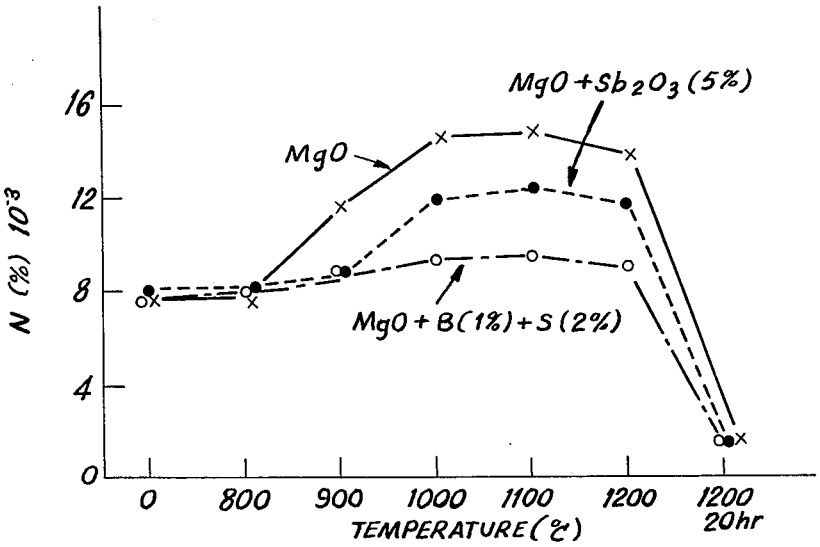
FIG. 1 shows the difference of $N_2$ content in the steel sheet caused by different separating agents during the finishing annealing process.

As seen in FIG. 1, the absorption of $N_2$ into the steel varies about the temperature (930°C) where the secondary recrystallization starts, depending on the separating agent used. The state of precipitation of AlN is probably varied, thereby developing the difference of the suppressing behavior.

It may be assumed as seen from FIG. 1 that B suppresses the absorption of $N_2$ while the boride suppresses the secondary recrystallized grain in the steel, and increases the suppressing effect of AlN. As a consequence, the secondary recrystallization grains become smaller or unstable as the acid-soluble aluminum in the steel material increases, and the secondary recrystallization grains are prevented from satisfactory growth.

In contrast, in case Sb or its compound is added, absorption of $N_2$ is suppressed up to 900°C, but increases rapdily about the secondary recrystallization temperature, i.e. 930°C. It may be assumed that at this point, AlN grows and its suppressive force is considerably reduced so that the preferred Goss orientation starts to grow fast. The secondary recrystallization grains in this case grow steadily, and the grain size becomes fairly large to 2.5 – 3 in ASTM No. while it is 3.5 – 4 in ASTM No. (x1) when B is added.

Figure 2:
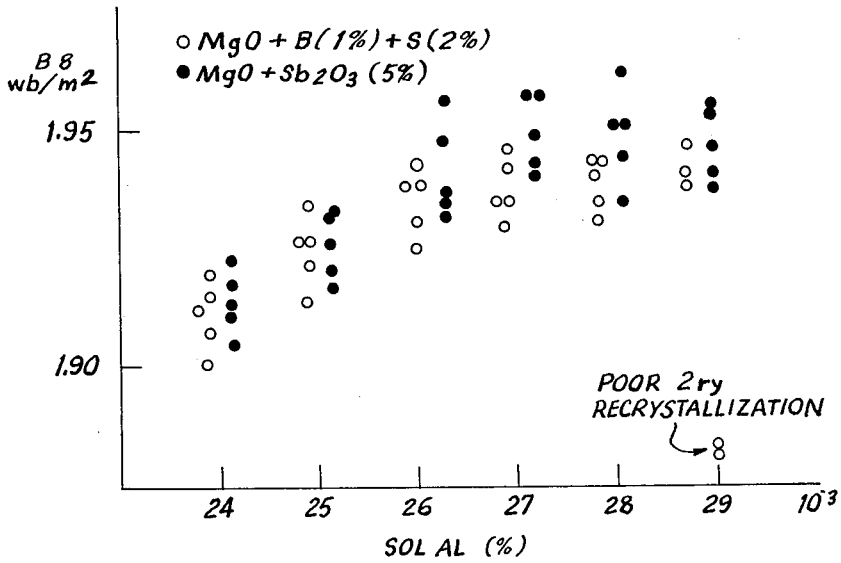
FIG. 2 illustrates the relation between $B_8$ characteristic of the product annealed after adding these elements and the aluminum content.

As seen in the FIG. 2, the $B_8$ characteristic improves by 0.01 – 0.02 Wb/m² and is stable as compared with that of the B-added samples, when 26 – 29 × $10^{-3}$% soluble aluminum is contained. The samples with B addition partly fail to produce satisfactorily secondary recrystallization grains when soluble aluminum increases to 29 × $10^{-3}$%, and become unstable.

The following is an example of the case in which S, Se, B or Sb is added to the separating MgO agent.

A silicon steel ingot containing 0.048% C, 2.80% Si, 0.026% Al, with the balance being Fe and unavoidable impurities was hot-rolled to 2.3 m/m in thickness, then annealed, and cold-rolled to 0.3 m/m. After decarburization annealing, MgO as a separating agent with the addition of 2% (% by weight on the bases of MgO) of S, Se, B or Sb was applied to the steel sheet and the steel sheet was subjected to the final annealing at 1200°C for 20 hours. As a result, the products indicating the following characteristics were obtained.

| Applied Agent | MgO | MgO+S (2%) | MgO+Se (2%) |
|---|---|---|---|
| $B_8$ (Wb/m²) | 19.1 | 19.2 | 19.1 |
| $W_{17/50}$ (W/kg) | 1.20 | 1.19 | 1.21 |
| Applied Agent | MgO+B (2%) | | MgO+Sb (2%) |
| $B_8$ (Wb/m²) | 19.4 | | 19.5 |
| $W_{17/50}$ (W/kg) | 1.14 | | 1.13 |

These elements, when added in a very small amount to the molten steel, each act to develop the secondary recrystallization grains in {110}<001> orientation. In case, these elements are added as a separating agent, their functions are not alike, producing differences in the magnetic characteristic as shown above.

Also by the addition of antimony or an antimony compound, the glass-like film produced during the final annealing is more uniform and has greater adhesion with the steel surface as compared with the case when MgO or MgO together with S, Se, B, etc. is used as the separating agent, so that the iron loss is also improved together with the improvement of the $B_8$ characteristics.

According to the present invention, silicon steel material containing 0.025 to 0.085% C, 2.0 to 4.0% Si and 0.010 to 0.065% acid soluble Al (referred to simply Al hereinafter) is used.

In order to precipitate the required amount of AlN during the annealing, it is necessary to control the carbon content in a range of 0.025 to 0.085%, and if the carbon content is less than 0.025% or more than 0.085%, even when the amount of AlN precipitating after the annealing is more than 0.0020% (N as AlN), the precipitate size is not appropriate and the secondary recrystallization grains of {110}<001> orientation are not obtained.

If the silicon content is less than 2.0% the electric resistance obtained is low and increased iron loss due to increased eddy iron loss is caused. If the silicon content is more than 4.0%, embrittlement crackings are caused during the cold rolling. Therefore, the silicon content is limited to the range of 2.0 to 4.0% in the present invention.

Further, Al is added to the steel in order to precipitate the desired Al before the final cold rolling, and is necessary particularly for obtaining $B_8$ characteristics of more than 1.90 Wb/m². This level of $B_8$ characteristics can not be obtained if the Al content is less than 0.01% or more than 0.065%. In addition, conventional addition elements, such as, S may be added to further increase the magnetic characteristics within the scope of the object of the present invention. The steel ingots or slabs used in the present invention may be any one obtained by conditional steel-making or melting methods, or continuous casting.

Normally, more than 0.0020% N is contained in commercially produced steel ingots or slabs, and this level is enough for forming the important AlN in the present invention.

The above steel material is hot rolled into a 1.5 to 7 mm thickness. The cold rolling is done normally by one step or two steps, but the number of the cold rolling step is not specifically limited in the present invention. The feature of the cold rolling lies in that the final cold rolling is done with a strong reduction rate of 81 to 95% in order to obtain more than 1.90 Wb/m², and it is important that AlN precipitation annealing is done before the cold rolling.

Regarding this AlN precipitation annealing, detailed descriptions are disclosed in Japanese Patent Publication Sho 46-23820. AlN precipitates obtained by this precipitation annealing are very fine and show favourable size and distribution for the secondary recrystallization grains, and it is necessary to maintain the precipitate condition without changing it until the secondary recrystallization temperature. The present invention has made the above possible.

The decarburization and the final annealing after the cold rolling may be above according to the conventional method, but the steel surface after the decarburization annealing is coated with the separating agent for preventing the burning of the steel sheets during the final annealing at a temperature above 1000°C. The addition of antimony or an antimony compound for obtaining the high magnetic flux density is made to the separating agent. As for the separating agent, MgO, $Al_2O_3$, $TiO_2$ etc. may be used alone or in combination. The antimony or the antimony compound used in the present invention includes simple antimony, silicates hydroxides and antimony, but exclude the compounds of alkali metals.

The desired effects of the addition of antimony or the antimony compound are not obtained if the addition is less than 0.1% as antimony, and antimony addition of more than 15% as antimony adversely affects the development of the secondary recrystallization and it is difficult to obtain high magnetic flux density grain-oriented electric steel sheets. Therefore, the desirable range of antimony addition is 0.2 to 15%.

The present invention will be more clearly understood from the following embodiments.

EXAMPLE 1

Silicon steel ingot containing 0.044% C, 2.80% Si and 0.025% Al was broken down hot rolled into 2.8 mm thick sheets. The sheets were annealed at 1130°C for 2 minutes, cooled in air, and acid pickled. Then the sheets were cold rolled to a final thickness of 0.30 mm and decarburized at 850°C for 3 minutes in a wet hydrogen atmosphere. The thus obtained steel sheets were coated with MgO as the separating agent with the addition of $Sb_2O_3$ in various amounts from 0 to 5% as antimony, and subjected to final annealing at 1200°C for 20 hours and the following results are obtained.

| Antimony Addition | $B_8$ | $W_{17/50}$ |
|---|---|---|
| 0 % | 1.91 (Wb/m²) | 1.23 (Watt/kg) |
| 1 | 1.92 | 1.21 |
| 3 | 1.95 | 1.13 |

-continued

| Antimony Addition | $B_8$ | $W_{17/50}$ |
|---|---|---|
| 5 | 1.96 | 1.04 |

EXAMPLE 2

Silicon steel ingot containing 0.039% C, 2.95% Si, 0.032% Al was broken down and hot rolled to a 2.3 mm thickness. The sheets were annealed in $N_2$ at 1100°C for 2 minutes, rapidly quenched in water at 100°C and acid pickled. Then two kinds of sheets having, respectively, final thicknesses of 0.35 mm and 0.27 mm were prepared and subjected to decarburization annealing. 2% by weight antimony was added to the MgO separating agent in the forms of antimony powder, antimony pentachloride, and antimony tri-iodide, and thus prepared separating agent was applied on the sheet surface and the final annealing was done at 1200°C for 20 hours.

| Sheet Thickness | Addition | $B_8$ (Wb/m²) | $W_{17/50}$ (Watt/kg) |
|---|---|---|---|
| 0.35 mm | None | 1.91 | 1.36 |
| | Antimony powder | 1.94 | 1.23 |
| | Antimony Pentachloride | 1.94 | 1.20 |
| | Antimony Tri-iodide | 1.92 | 1.25 |
| 0.27 mm | None | 1.90 | 1.20 |
| | Antimony powder | 1.95 | 1.03 |
| | Antimony Pentachloride | 1.96 | 1.00 |
| | Antimony Tri-iodide | 1.93 | 1.10 |

EXAMPLE 3

Silicon steel ingot containing 0.044% C, 2.89% Si, and 0.027% Al was broken down and hot rolled to a 2.3 mm thickness, and annealed in $N_2$ at 1120°C for 2 minutes, rapidly cooled in water at 100°C, acid pickled, cold rolled to a 0.270 mm thickness, and subjected to decarburization annealing. Then a separating agent of MgO with the addition of $Sb_2O_3$ was applied on the steel sheets, and final annealing was done at 1200°C for 20 hours. The results were as follows:

| Antimony Addition(%) | $B_8$(Wb/m²) | $W_{17/50}$ (Watt/kg) |
|---|---|---|
| 0 | 1.92 | 1.17 |
| 0.1 | 1.92 | 1.15 |
| 0.2 | 1.93 | 1.13 |
| 0.5 | 1.93 | 1.13 |
| 1.0 | 1.94 | 1.14 |

EXAMPLE 4

Silicon steel containing 0.046% C, 2.87% Si and 0.022% Al was hot rolled to a 2.3 mm thickness, annealed and cold rolled to final thickness of 0.27 mm. After decarburization annealing, the sheets were coated with a separating agent of MgO with the addition of $Sb_2O_3$ and subjected to final annealing at 1200°C for 20 hours. The results are as under.

| Addition of $Sb_2O_3$(%) | $B_8$(Wb/m²) | $W_{17/50}$ (Watt/kg) |
|---|---|---|
| 0 | 18.8 | 1.23 |
| 5 | 19.2 | 1.15 |
| 10 | 19.2 | 1.14 |
| 15 | 19.0 | 1.18 |
| 18 | 18.7 | 1.25 |

As clearly shown by the above examples, the steel sheets coated with the separating agent with the addition of antimony or an antimony compound according to the present invention have excellent magnetic flux density and iron loss value.

What is claimed is:

1. In a process for producing grain-oriented electric steel sheets having remarkably improved magnetic flux density comprising hot rolling silicon steel material containing 0.025 to 0.085% C, 2.0 to 4.0% Si, 0.010 to 0.065% acid soluble Al, continuously annealing the steel at a high temperature between 950°and 1200°C before final strong cold rolling, rapidly cooling the steel to precipitate AlN, cold rolling the steel by a one-step or two-step cold rolling including a final strong cold rolling with a reduction rate range of 81 to 95% into a final thickness, coating a separating agent on the sheet after decarburization annealing, and subjecting the sheet to final annealing to obtain a grain oriented electric steel sheet having excellent excitation characteristics and $B_8$ characteristics of at least more than 1.90 $Wb/m^2$, the improvement which comprises effecting the final annealing by applying a separating agent with antimony or an antimony-containing compound (excluding alkali metal compound) added in 0.2 – 15% by weight as antimony.

2. A process according to claim 1, in which the antimony compound is one or more selected from the group consisting of silicates, hydroxides and oxides of antimony.

* * * * *